US006047482A

United States Patent [19]

Roper

[11] Patent Number: 6,047,482

[45] Date of Patent: Apr. 11, 2000

[54] PORTABLE CLOTHES DRYER

[76] Inventor: Michael A. Roper, 135 Hawthorne Street #3G, Brooklyn, N.Y. 11225

[21] Appl. No.: 09/054,243

[22] Filed: Apr. 2, 1998

[51] Int. Cl.[7] ..... F26B 25/00

[52] U.S. Cl. ..... 34/106; 34/622

[58] Field of Search ..... 34/312, 443, 58, 34/60, 61, 62, 64, 67, 97, 98, 106, 621, 622, 187; 223/51, 52, 70; D32/58; 219/389, 401, 533; 392/380, 384, 403

[56] References Cited

U.S. PATENT DOCUMENTS

| | | | |
|---|---|---|---|
| D. 263,923 | 4/1982 | Koshiyama | D32/58 |
| 1,833,631 | 11/1931 | Wilsey | 34/621 X |
| 2,994,965 | 8/1961 | Tuhy | 34/621 X |
| 3,626,602 | 12/1971 | Glowacki | 34/622 |
| 3,858,331 | 1/1975 | Lord | 34/621 |
| 4,035,927 | 7/1977 | Spiegel | 34/621 |
| 4,592,497 | 6/1986 | Georges | 223/69 |
| 5,778,556 | 7/1998 | Ohsugi | 34/106 |

*Primary Examiner*—Henry Bennett
*Assistant Examiner*—Steve Gravini

[57] ABSTRACT

A new portable clothes dryer for quickly drying clothes and other items, especially in a limited space. The inventive device includes an elongate main housing and a control housing adapted for attachment to a structure. A shaft extends between the top of the main housing and the lower end of the control housing. A hub is rotatably mounted on the shaft to permit rotation of the hub about longitudinal axis of the shaft. A motor is provided for rotating the hub about the longitudinal axis of the shaft. A plurality of elongate arms are radially extended outwards from the hub. The side wall of the main housing has a plurality of openings into the interior of the main housing to permit the passage of air. A heater and fan are provided in the interior of the housing for heating and blowing air.

11 Claims, 4 Drawing Sheets

PORTABLE CLOTHES DRYER

BACKGROUND OF THE INVENTION

1. Field of the Invention

The present invention relates to clothes drying apparatuses and more particularly pertains to a new portable clothes dryer for quickly drying clothes and other items, especially in a limited space.

1. Description of the Prior Art

The use of clothes drying apparatuses is known in the prior art. More specifically, clothes drying apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art toys include U.S. Pat. No. 4,035,927; U.S. Pat. No. 4,592,497; U.S. Pat. No. Des. 263,923; U.S. Pat. No. 5,388,344; U.S. Pat. No. 4,572,364; and U.S. Pat. No. 4,765,162.

While these devices fulfill their respective, particular objectives and requirements, the aforementioned patents do not disclose a new portable clothes dryer. The inventive device includes an elongate main housing and a control housing adapted for attachment to a structure. A shaft extends between the top of the main housing and the lower end of the control housing. A hub is rotatably mounted on the shaft to permit rotation of the hub about longitudinal axis of the shaft. A motor is provided for rotating the hub about the longitudinal axis of the shaft. A plurality of elongate arms are radially extended outwards from the hub. The side wall of the main housing has a plurality of openings into the interior of the main housing to permit the passage of air. A heater and fan are provided in the interior of the housing for heating and blowing air.

In these respects, the portable clothes dryer according to the present invention substantially departs from the conventional concepts and designs of the prior art, and in so doing provides an apparatus primarily developed for the purpose of quickly drying clothes and other items, especially in a limited space.

SUMMARY OF THE INVENTION

In view of the foregoing disadvantages inherent in the known types of clothes drying apparatuses now present in the prior art, the present invention provides a new portable clothes dryer construction wherein the same can be utilized for quickly drying clothes and other items, especially in a limited space.

The general purpose of the present invention, which will be described subsequently in greater detail, is to provide a new portable clothes dryer apparatus and method which has many of the advantages of the clothes drying apparatuses mentioned heretofore and many novel features that result in a new portable clothes dryer which is not anticipated, rendered obvious, suggested, or even implied by any of the prior art clothes drying apparatuses, either alone or in any combination thereof.

To attain this, the present invention generally comprises an elongate main housing and a control housing adapted for attachment to a structure. A shaft extends between the top of the main housing and the lower end of the control housing. A hub is rotatably mounted on the shaft to permit rotation of the hub about longitudinal axis of the shaft. A motor is provided for rotating the hub about the longitudinal axis of the shaft. A plurality of elongate arms are radially extended outwards from the hub. The side wall of the main housing has a plurality of openings into the interior of the main housing to permit the passage of air. A heater and fan are provided in the interior of the housing for heating and blowing air.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable clothes dryer apparatus and method which has many of the advantages of the clothes drying apparatuses mentioned heretofore and many novel features that result in a new portable clothes dryer which is not anticipated, rendered obvious, suggested, or even implied by any of the prior art clothes drying apparatuses, either alone or in any combination thereof.

It is another object of the present invention to provide a new portable clothes dryer which may be easily and efficiently manufactured and marketed.

It is a further object of the present invention to provide a new portable clothes dryer which is of a durable and reliable construction.

An even further object of the present invention is to provide a new portable clothes dryer which is susceptible of a low cost of manufacture with regard to both materials and labor, and which accordingly is then susceptible of low prices of sale to the consuming public, thereby making such portable clothes dryer economically available to the buying public.

Still yet another object of the present invention is to provide a new portable clothes dryer which provides in the apparatuses and methods of the prior art some of the advantages thereof, while simultaneously overcoming some of the disadvantages normally associated therewith.

Still another object of the present invention is to provide a new portable clothes dryer for quickly drying clothes and other items, especially in a limited space.

Yet another object of the present invention is to provide a new portable clothes dryer which includes an elongate main housing and a control housing adapted for attachment to a structure. A shaft extends between the top of the main housing and the lower end of the control housing. A hub is rotatably mounted on the shaft to permit rotation of the hub about longitudinal axis of the shaft. A motor is provided for rotating the hub about the longitudinal axis of the shaft. A plurality of elongate arms are radially extended outwards from the hub. The side wall of the main housing has a plurality of openings into the interior of the main housing to permit the passage of air. A heater and fan are provided in the interior of the housing for heating and blowing air.

Still yet another object of the present invention is to provide a new portable clothes dryer that is collapsible for convenient storage and easy transportation.

Even still another object of the present invention is to provide a new portable clothes dryer that allows a user to dry a few clothes quickly without having to use a large conventional clothes dryer thereby avoiding wasting excessive energy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
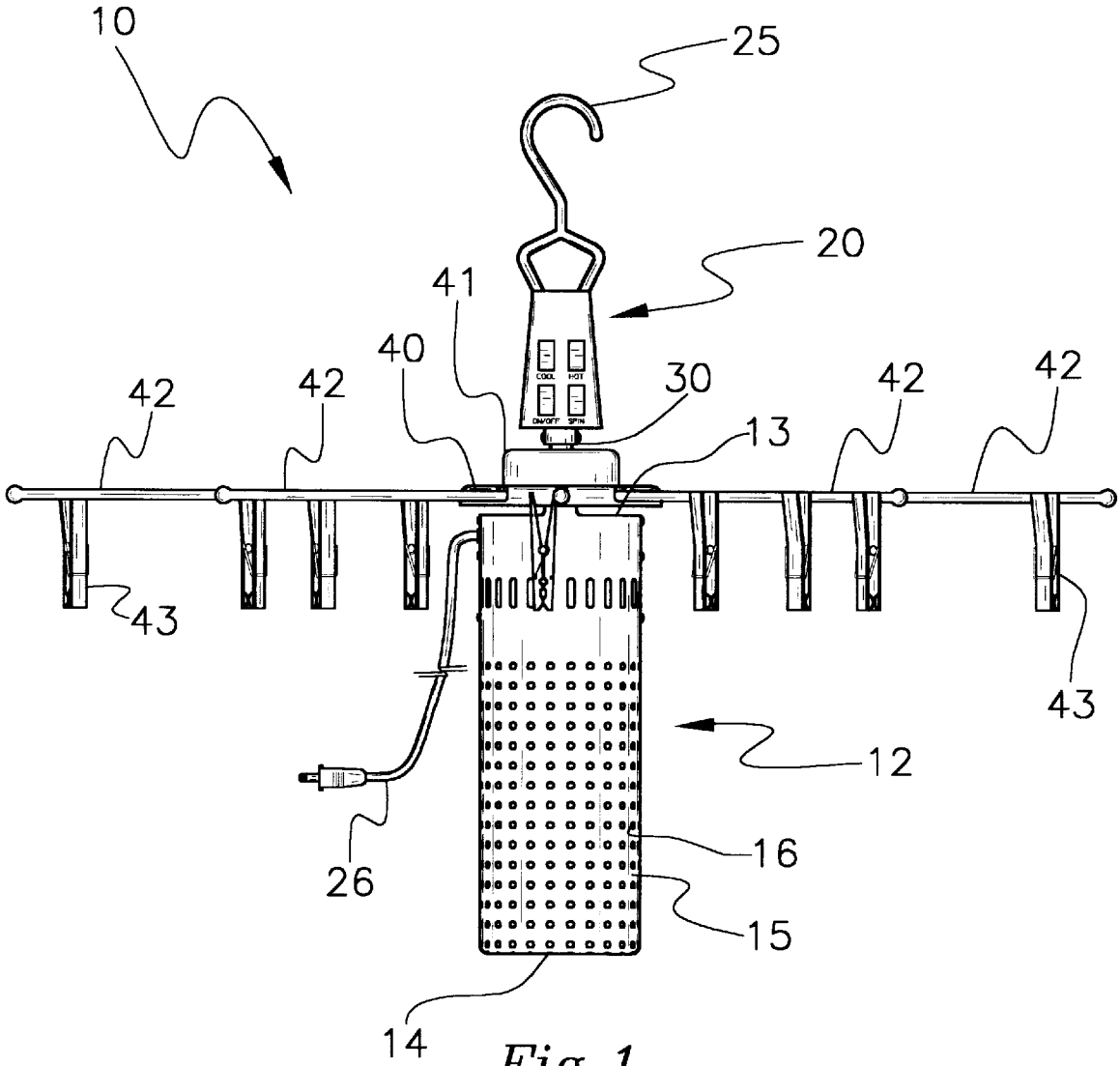
FIG. 1 is a schematic side view of a new portable clothes dryer according to the present invention.

With reference now to the drawings, and in particular to FIGS. 1 through 4 thereof, a new portable clothes dryer embodying the principles and concepts of the present invention and generally designated by the reference numeral 10 will be described.

As best illustrated in FIGS. 1 through 4, the portable clothes dryer generally comprises an elongate main housing 12 and a control housing 20 adapted for attachment to a structure. A shaft 30 extends between the top 13 of the main housing 12 and the lower end of the control housing 20. A hub 40 is rotatably mounted on the shaft 30 to permit rotation of the hub 40 about longitudinal axis of the shaft 30. A motor 41 is provided for rotating the hub 40 about the longitudinal axis of the shaft 30. A plurality of elongate arms 42 are radially extended outwards from the hub 40. The side wall 15 of the main housing 12 has a plurality of openings 16 into the interior of the main housing 12 to permit the passage of air. A heater 44 and fan 46 are provided in the interior of the housing for heating and blowing air.

The clothes drying apparatus is designed for providing a portable apparatus for drying clothes. Specifically, the elongate main housing 12 is generally cylindrical and has a top 13 and a bottom 14. The main housing 12 also has a perimeter side wall 15 which is extended between the top 13 and bottom 14 of the main housing 12. The longitudinal axis of the main housing 12 extends between the top 13 and bottom 14 of the main housing 12. Ideally, the main housing 12 has a length of less than about 11 inches and a diameter of less than about 5 inches so that the apparatus may be easy transported between locations.

The control housing 20 has opposite upper and lower ends with the upper end of the control housing 20 adapted for attachment to a structure. Preferably, a hook 25 is upwardly extended from the upper end of the control housing 20 for hanging on a structure such as a clothes rod or a clothes line.

The shaft 30 extends between the top 13 of the main housing 12 and the lower end of the control housing 20. Preferably, the longitudinal axis of the shaft 30 is substantially coaxial with the longitudinal axis of the main housing 12 and its upper end is coupled to the lower end of the control housing 20 while its lower end is coupled to the top 13 of the main housing 12.

Preferably, the hub 40 is generally circular and has a center and an outer perimeter or circumference. The hub 40 is rotatably mounted on the shaft 30 to permit rotation of the hub 40 about the shaft 30. The hub 40 is mounted on the shaft 30 such that the center is coaxial with the longitudinal axis of the shaft 30. The hub 40 has a motor 41 provided thereon for rotating the hub 40 about the longitudinal axis of the shaft 30. Preferably, the motor 41 and hub 40 arrangement is of the type commonly found in overhead ceiling fans.

Figure 2:
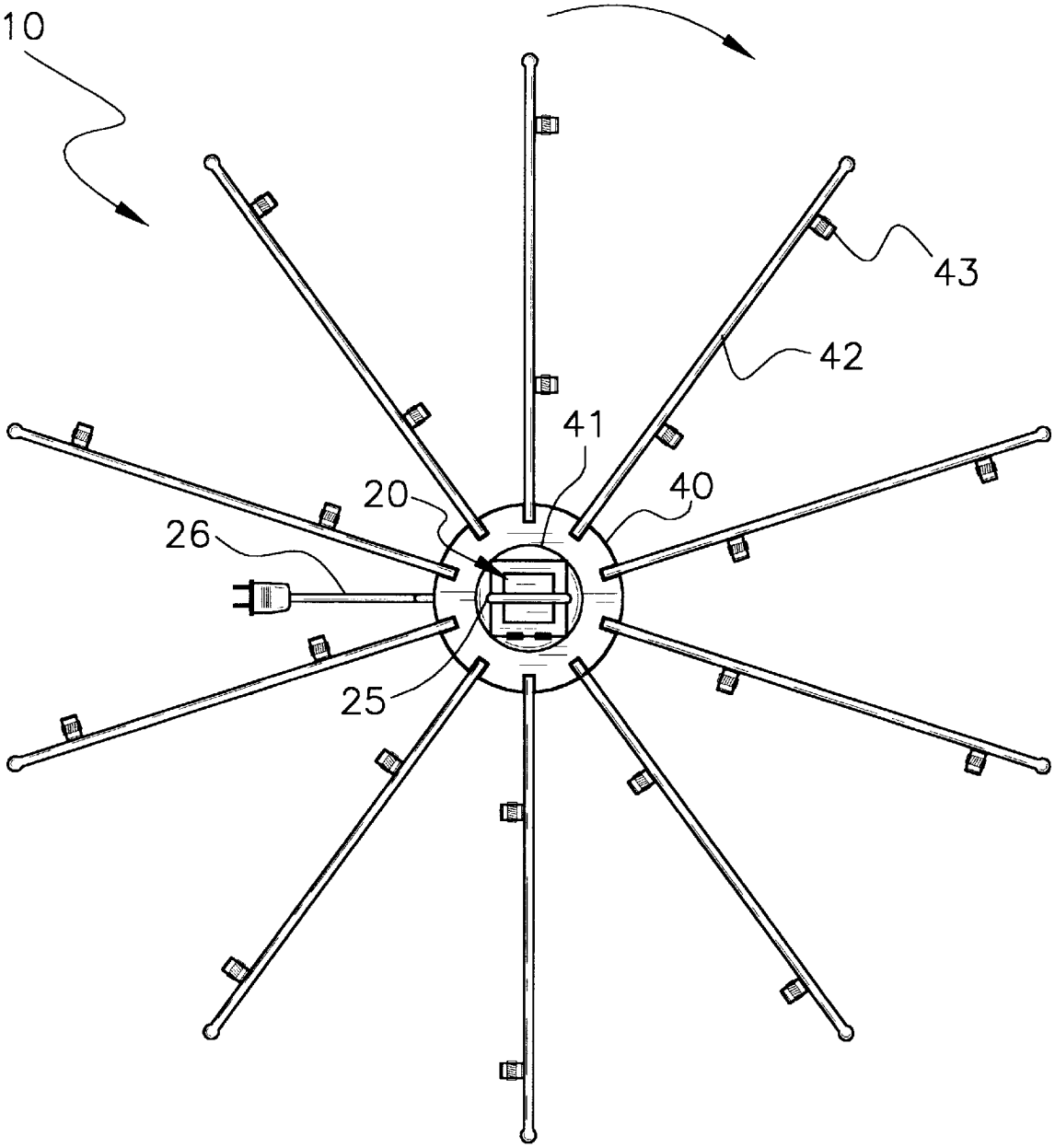
FIG. 2 is a schematic top view of the present invention.
Figure 3:
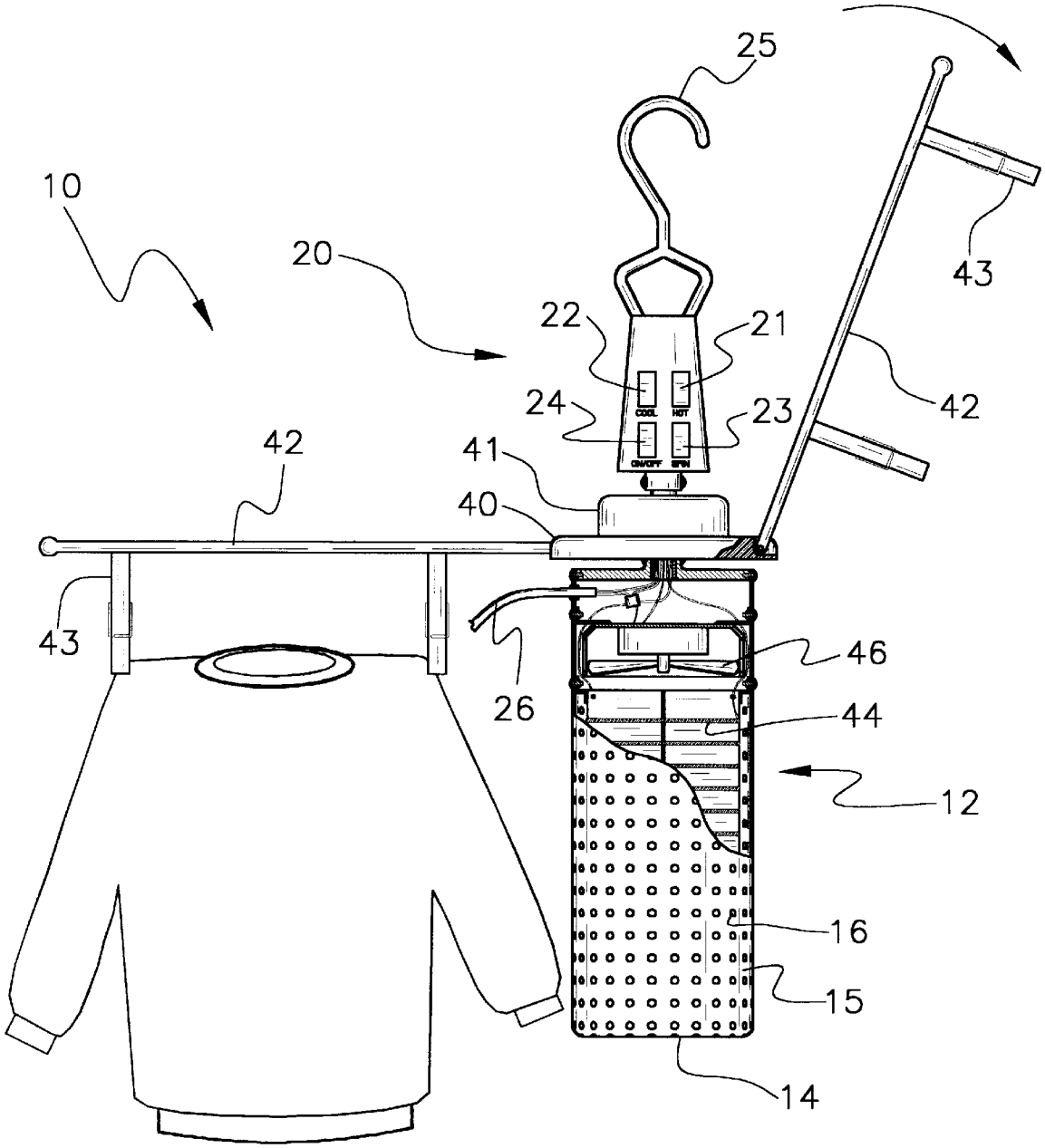
FIG. 3 is a schematic side view of the present invention in use.
Figure 4:
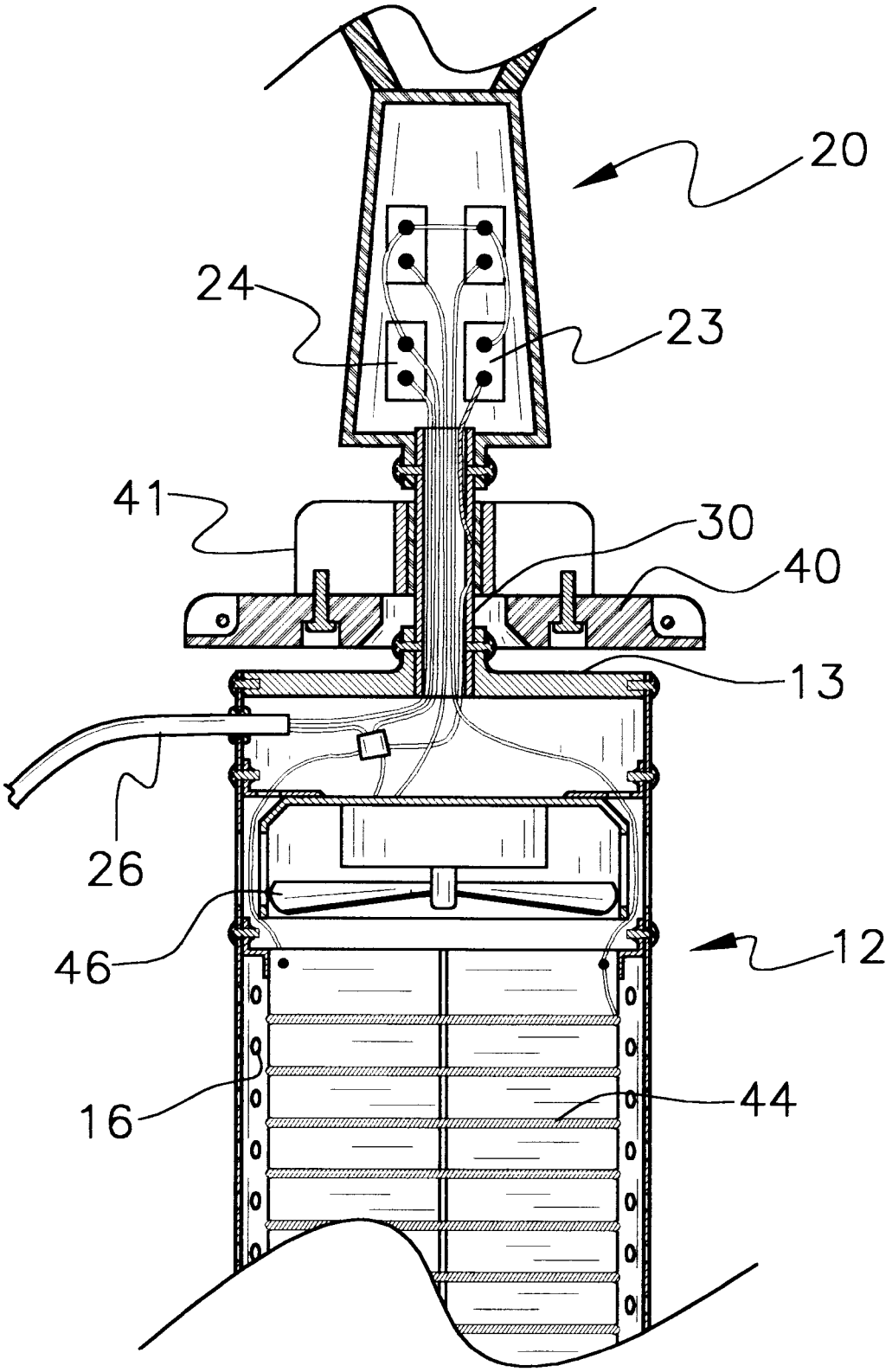
FIG. 4 is a schematic partial sectional view of the present invention.

As illustrated in FIG. 2, the plurality of elongate arms 42 are radially extended outwards from the hub 40. Preferably, the arms 42 is pivotally coupled to the outer perimeter of the hub 40. Preferably, each of the arms 42 are pivotable between a first position and a second position. When in the first position, the lengths of the arms 42 are substantially perpendicular to the longitudinal axis of the shaft 30. When in the second position, the lengths of the arms 42 are generally parallel with the longitudinal axis of the shaft 30. The first position is designed for deployment of the arms 42 while in use. Conversely, the second position is designed for collapsing of the arms 42 for convenient storage of the apparatus. In the preferred embodiment of the apparatus, a plurality of spaced apart fasteners 43 are provided on each of the arms 42 for attaching items such a clothes to the arms 42. Ideally, the fasteners 43 are clothes pin coupled to their associated arm.

The side wall 15 of the main housing 12 has a plurality of openings 16 into the interior of the main housing 12. The openings 16 of the side wall 15 of the main housing 12 are designed for permitting the passage of air through it. The heater 44 is provided in the interior of the housing and is designed for heating air in the interior of the housing for helping dry clothes hanging from the arms 42. The fan 46 is provided in the interior of the housing and is designed for blowing air between the interior of the housing and the exterior of the housing so that air (either heated or not heated) is blown over items, such as clothes, hanging on the arms 42.

The control housing 20 has a plurality of actuators provided on it which are designed for selectively controlling the various features of the clothes drying apparatus. The plurality of actuators includes first, second and third actuators 21,22,23. The first actuator 21 is operatively connected to the heater 44 to control activation of the heater 44. The second actuator 22 is operatively connected to the fan 46 to control activation of the fan 46. The third actuator 23 is operatively connected to the motor 41 of the hub 40 to control rotation of the hub 40. Ideally, a fourth actuator 24 is includes and is operatively coupled to the power source (which may be a battery or connected to the apparatus by a power cord) of the motor 41, fan 46 and heater 44 for controlling the activation of all of the features. This arrangement of actuators 21,22,23,24 permits a user to individually activate or deactivate the fan 46, heater 44 and motor 41 independently from one another while still having an actuator for activating and deactivating all of them at once. In use, a user hangs items on the arms 42 and then activates the heater 44, fan 46, and motor 41 as desired to dry the items.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothes drying apparatus, comprising:

an elongate main housing having a longitudinal axis, an interior, a top, a bottom, and a perimeter side wall being extended between said top and bottom of said main housing, said longitudinal axis of said main housing being extended between said top and bottom of said main housing;

a control housing having opposite upper and lower ends, said upper end of said control housing being adapted for attachment to a structure;

a shaft being extended between said top of said main housing and said lower end of said control housing, said shaft having a longitudinal axis and a pair of opposite upper and lower ends;

a hub being rotatably mounted on said shaft to permit rotation of said hub about longitudinal axis of said shaft;

a motor for rotating said hub about said longitudinal axis of said shaft;

a plurality of elongate arms being radially extended outwards from said hub;

said side wall of said main housing having a plurality of openings into said interior of said main housing;

a heater being provided in said interior of said housing;

a fan being provided in said interior of said housing.

2. The apparatus of claim 1, wherein said main housing is generally cylindrical.

3. The apparatus of claim 1, wherein said upper end of said control housing has a hook being upwardly extended therefrom, said hook being for hanging on a structure.

4. The apparatus of claim 1, wherein said longitudinal axis of said shaft is substantially coaxial with said longitudinal axis of said main housing.

5. The apparatus of claim 1, wherein said hub is generally circular and ha a center and an outer perimeter.

6. The apparatus of claim 1, wherein said arms are pivotally coupled to said outer perimeter of said hub, and wherein each of said arms ha a length.

7. The apparatus of claim 6, wherein each of said arms is pivotable between a first position wherein said lengths of said arms are substantially perpendicular to said longitudinal axis of said shaft and a second position wherein said lengths of said arms are generally parallel with said longitudinal axis of said shaft.

8. The apparatus of claim 1, wherein said motor is provided on said hub.

9. The apparatus of claim 1, further comprising a plurality of spaced apart fasteners being provided on each of said arms, said fasteners being for attaching items to said arms.

10. The apparatus of claim 1, wherein said control housing has a plurality of actuators provided thereon, said plurality of actuators including first, second and third actuators, said first actuator being operatively connected to said heater, said second actuator being operatively connected to said fan, said third actuator being operatively connected to said motor of said hub.

11. A clothes drying apparatus, comprising:

an elongate main housing being generally cylindrical and having a longitudinal axis, an interior, a top, a bottom, and a perimeter side wall being extended between said top and bottom of said main housing, said longitudinal axis of said main housing being extended between said top and bottom of said main housing;

a control housing having opposite upper and lower ends, said upper end of said control housing being adapted for attachment to a structure and having a hook being upwardly extended therefrom, said hook being for hanging on a structure;

a shaft being extended between said top of said main housing and said lower end of said control housing, said shaft having a longitudinal axis and a pair of opposite upper and lower ends, said longitudinal axis of said shaft being substantially coaxial with said longitudinal axis of said main housing;

a hub being generally circular and having a center and an outer perimeter, said hub being rotatably mounted on said shaft to permit rotation of said hub about said shaft;

said hub having a motor provided thereon for rotating said hub about said longitudinal axis of said shaft;

a plurality of elongate arms being radially extended outwards from said hub, said arms being pivotally coupled to said outer perimeter of said hub, each of said arms having a length, each of said arms being pivotable between a first position wherein said lengths of said arms are substantially perpendicular to said longitudinal axis of said shaft and a second position wherein said lengths of said arms are generally parallel with said longitudinal axis of said shaft;

a plurality of spaced apart fasteners being provided on each of said arms, said fasteners being for attaching items to said arms, wherein said fasteners are clothes pin coupled to their associated arm;

said side wall of said main housing having a plurality of openings into said interior of said main housing;

a heater being provided in said interior of said housing;

a fan being provided in said interior of said housing; and said control housing having a plurality of actuators provided thereon, said plurality of actuators including first, second and third actuators, said first actuator being operatively connected to said heater, said second actuator being operatively connected to said fan, said third actuator being operatively connected to said motor of said hub.

* * * * *